United States Patent [19]

Nye, Jr.

[11] Patent Number: 4,554,696

[45] Date of Patent: Nov. 26, 1985

[54] GOLF CLUB GRIP CLEANER

[76] Inventor: Gerald P. Nye, Jr., 4940 Cloister Dr., Rockville, Md. 20852

[21] Appl. No.: 672,474

[22] Filed: Nov. 16, 1984

[51] Int. Cl.[4] ..... A63B 57/00; A46B 13/04

[52] U.S. Cl. ..... 15/21 D; 15/21 E; 15/76; 15/104.04

[58] Field of Search ..... 15/21 D, 21 E, 65, 67, 15/69, 75, 76, 104.04, 104.92, 56, 88

[56] References Cited

U.S. PATENT DOCUMENTS

| | | | |
|---|---|---|---|
| 981,417 | 1/1911 | Halsey et al. | 15/65 |
| 1,971,206 | 8/1934 | Adelmann | 15/56 |
| 2,274,309 | 2/1942 | Velton | 15/56 |
| 2,907,059 | 10/1959 | Cornett | 15/65 X |
| 3,224,029 | 12/1965 | Domingos | 15/104.92 |
| 3,500,489 | 3/1970 | Cox et al. | 15/76 |

FOREIGN PATENT DOCUMENTS

| | | | |
|---|---|---|---|
| 1457053 | 2/1969 | Fed. Rep. of Germany | 15/56 |

*Primary Examiner*—Edward L. Roberts
*Attorney, Agent, or Firm*—Brady, O'Boyle & Gates

[57] ABSTRACT

An electrically powered brush assembly for the wet scrubbing and cleaning of the hand grip of a piece of athletic equipment such as the grip of a golf club. The assembly is comprised of an elongated housing including an upper compartment which is adapted to receive the grip end of a golf club and contains a liquid cleaning agent and at least one, but preferably a plurality of elongated brushes arranged for contacting the surface of grip as well as a lower compartment which contains an electric drive motor, a grip actuated switch, and a gear train which couples to the brush(es) through an adjoining wall between the compartments. The brush or brushes are coextensive and aligned with the length of the grip and are powered by the electric motor to axially rotate and thus scrub the grip when the butt end of the grip actuates the switch.

8 Claims, 7 Drawing Figures

GOLF CLUB GRIP CLEANER

BACKGROUND OF THE INVENTION

This invention relates generally to accessories for athletic equipment and more particularly to means for cleaning the hand grip of a piece of athletic equipment such as the grip of a golf club.

It is a well known fact that the grips of golf clubs become hard and slippery and lose their "feel" due to the build up of dirt and perspiration received from the hands of the person using the clubs during the playing of a round of golf or during a practice session. This is particularly true of the modern type composition grips, but is applicable as well to the old fashion leather grips. It is highly desirable, therefore, to frequently clean the grips of golf clubs either before or after their use. It is also desirable that a device for cleaning the grips of golf clubs be made readily available not only at the various golf courses where sets of clubs are cleaned and stored between use, but also for individual use where, for example, one may wish to take care of his or her clubs elsewhere, such as at home.

While the present invention is not meant to be specifically limited to a golf accessory, one known golf grip cleansing device is known, namely that shown and described in U.S. Pat. No. 3,224,029 issued to J. E. Damingos on December 21, 1965. The specification of that patent discloses a device which manually requires a repetitive up and down movement of the grip against the bristles of a pair of cleansing brushes located at the top part of a housing which also contains a cleansing liquid in the lower part thereof but out of direct contact with the brushes.

Accordingly, it is an object of the present invention to provide an improvement in apparatus for the cleaning of athletic equipment.

It is another object of the invention to provide improvement in apparatus for the cleaning of grips of athletic equipment.

It is yet another object of the invention to provide an improvement in apparatus for the cleaning of the grips of golf clubs or the like.

SUMMARY

Briefly, the foregoing and other objects of the invention are provided by an electrically powered brush assembly contained in a housing including upper and lower compartments or sections. The upper section contains at least one plurality of elongated brushes which are adapted to rotate on axes which are substantially parallel to the axis of an inserted shaft of, for example, a golf club having a grip affixed to one end. The brushes are surrounded by a cleaning liquid and are rotated by an electric motor located in the lower compartment or section which also includes a drive gear train which couple through a common wall separating the compartments to rotate the brushes when the electric motor is energized. Furthermore, an electrical switch for energizing the electric motor is mounted in the common wall so as to be actuated to turn the motor on when the butt end of the grip contacts the switch when it is inserted between the brushes.

BRIEF DESCRIPTION OF THE DRAWINGS

While the present invention is defined in the claims annexed to and forming a part of this specification, a better understanding can be had by reference to the following description taken in conjunction with the accompanying drawings in which:

DESCRIPTION OF THE PREFERRED EMBODIMENTS

Figure 1:
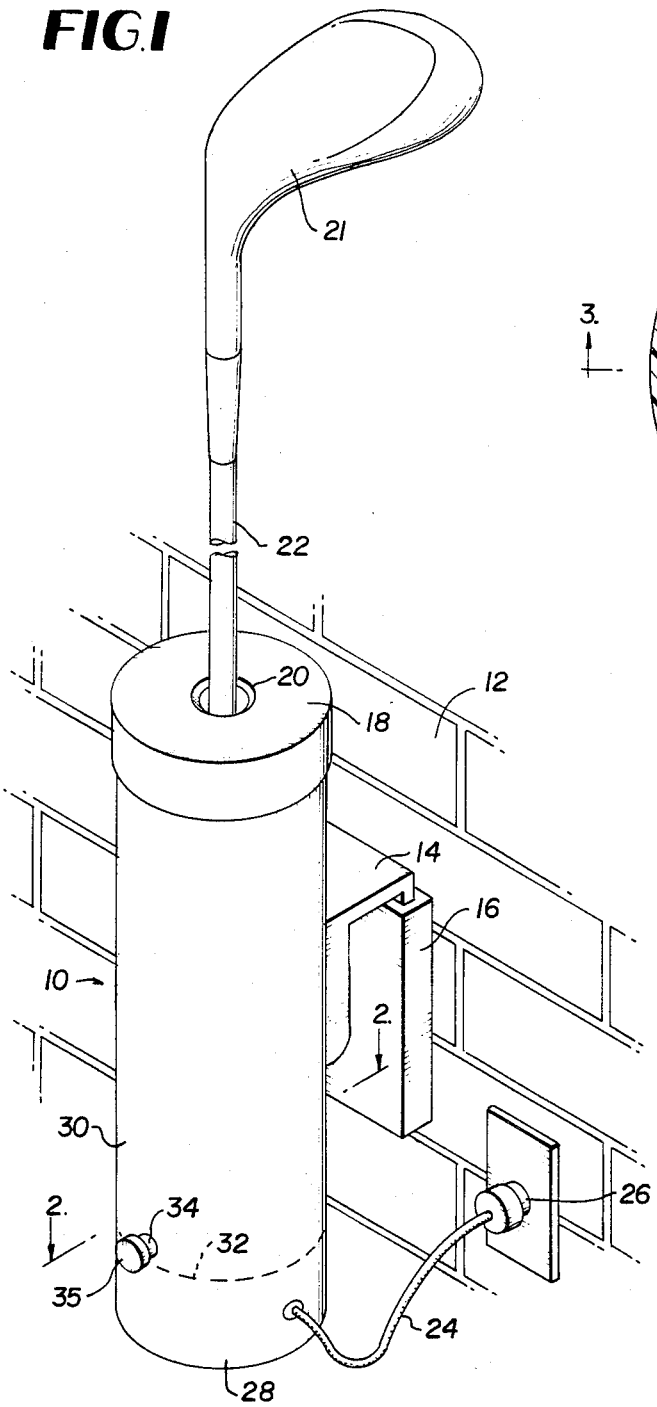
FIG. 1 is a perspective view of an embodiment of the subject invention and which is shown for purposes of illustration mounted on a wall.

Referring now to the drawings and more particularly to the embodiment shown in FIG. 1, reference numeral 10 denotes a generally cylindrical canister type housing which is mounted for purposes of illustration on a brick wall 12 by means of a bracket member 14 which fits into a receptor element 16 attached to the wall. The housing 10 additionally includes a generally circular top cover member 18 which includes a central opening 20 for the insertion of the grip end of a golf club 21 including a shaft 22, as shown. An electrical power cord 24 is also shown for coupling power from an electrical wall outlet 26 to an electrical drive motor located in a lower compartment 28 which is separated from an upper compartment 30 by a wall 32, the details of which are disclosed in FIG. 3 and will be considered subsequently. Although not shown in FIG. 1, the upper compartment 30 contains a motor driven brush assembly and cleansing liquid, the latter of which can be removed through a drain 34 located at the bottom of compartment 30 and which is normally closed by a screw threaded cap 35.

Figure 2:
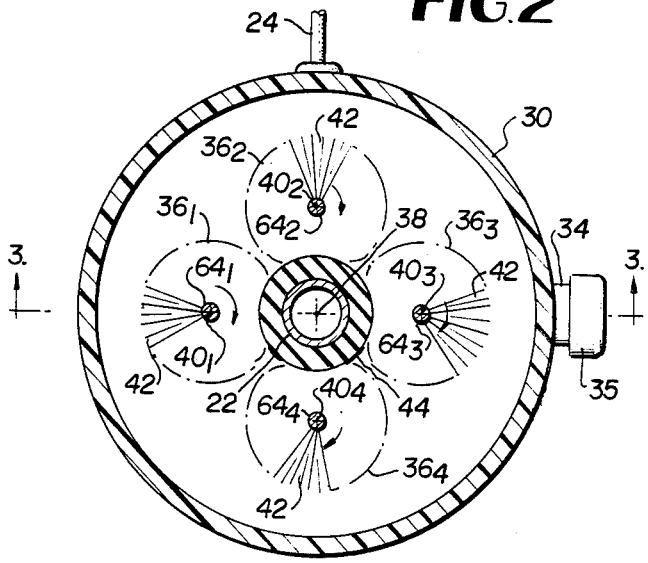
FIG. 2 is a transverse cross sectional view of the housing shown in FIG. 1 taken along the line 2—2 thereof.

Considering now the details of the embodiment shown in FIG. 1, as shown in FIGS. 2 through 5, the upper compartment 30 contains at least one but preferably four elongated brushes $36_1$, $36_2$, $36_3$ and $36_4$ which are equally spaced around a central longitudinal axis 38 (FIG. 2). The brushes $36_1 \ldots 36_4$ are rotatable about respective axes $40_1$, $40_2$, $40_3$ and $40_4$ which are parallel to the central longitudinal axis 38. This is specifically shown by the two opposing brushes $40_1$ and $40_3$ of FIG. 3. Moreover, the diameters from the brushes themselves are chosen so that the bristles 42 or other similar type scrubbing elements are in frictional contact with the entire length of a golf club grip 44 affixed to the end of the shaft 22, when inserted into the upper compartment 30 through the central opening 20. Since a golf club grip normally tapers downwardly frmm its butt end 46 to its inner end 48, the bristles 42 of the brushes $36_1 \ldots 36_4$ deforms to accommodate the shape of the grip as shown with the dashed lines 50 and 52 of FIG. 3 indicating the outline of the outer surfaces of the brushes $36_1$ and $36_3$.

Figure 3:
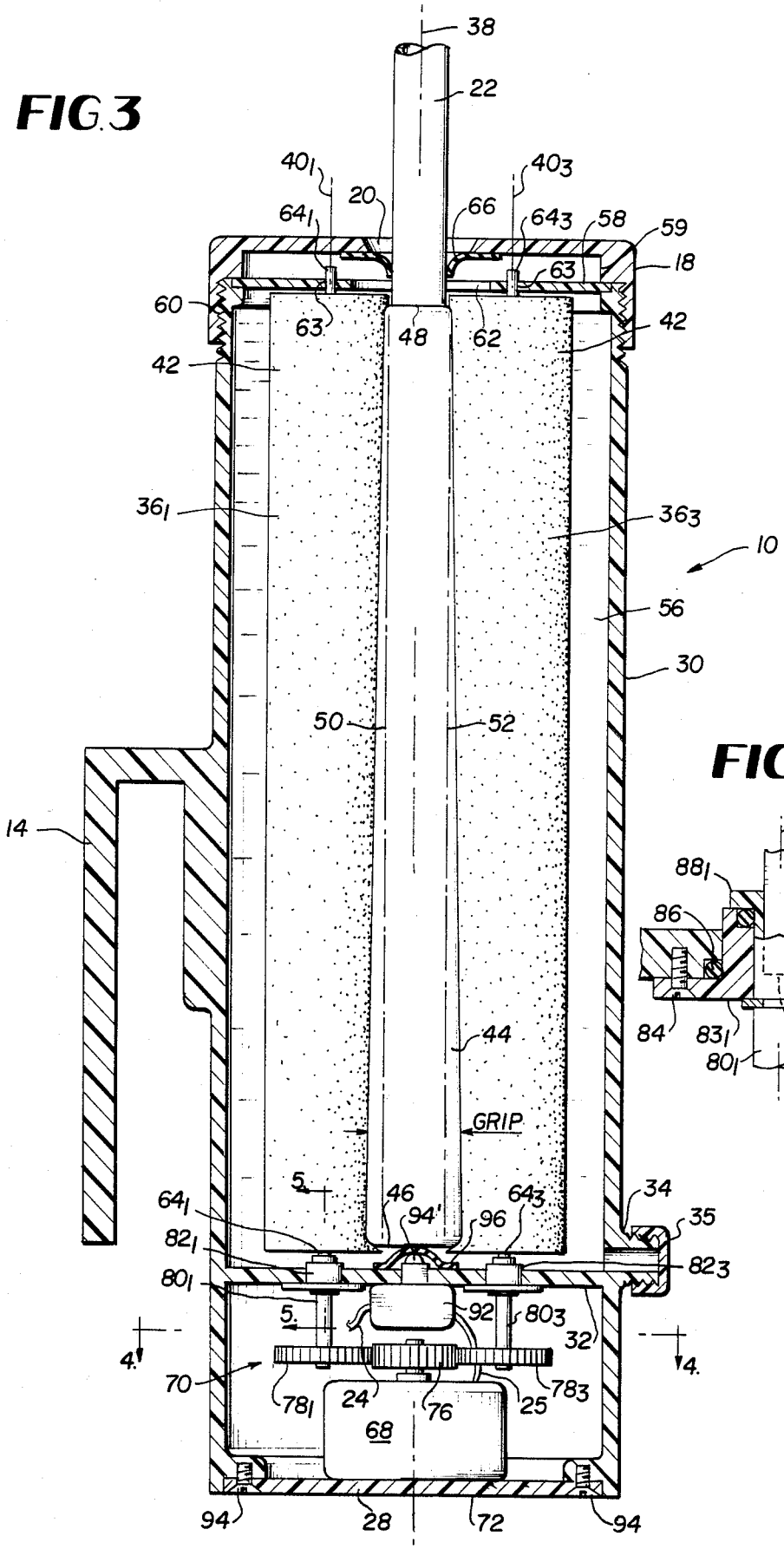
FIG. 3 is a longitudinal cross sectional view of FIG. 2 taken along the line 3—3.

The set of rotatable brushes $36_1$, $36_2$, $36_3$ and $36_4$ are axially mounted in the upper compartment 30 which is also adapted to contain a grip cleansing liquid, e.g. a liquid detergent or soapy solution which will envelop the brushes $36_1 \ldots 36_4$ as well as the grip 44. As shown in FIG. 3, the brushes $36_1 \ldots 36_4$ are vertically aligned with the central axis 38 of housing 10 and are held in place at the top by a flat plate 58 seated on the upper rim of the compartment 30. The plate 58 is constrained by means of the top cover member 18 which includes a threaded inner wall surface 59 which is adapted to engage the threads 60 located on the outer surface 60 of the top part of the upper compartment 30. The plate 58 also includes a central circular opening 62 which permits passage of a grip 44 into the brush compartment 30. The plate 58 also includes a set of equally spaced holes 63 for holding, yet permitting free rotation of the upper end of the spindles of the brushes, two of which are shown by reference numerals $64_1$ and $64_3$ in FIG. 3. It should also be pointed out that the threaded top cover member 18 also includes a flexible flap member 66 on its inner surface adjoining the central opening 20. The purpose of the flap member 66 is to prevent debris from getting into the compartment 30 as well as preventing any of the cleaning liquid from splashing out of the compartment 30 during operation.

Figure 4:
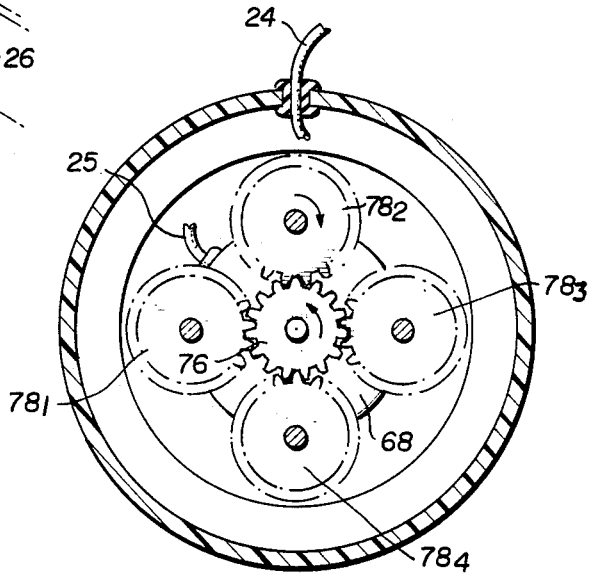
FIG. 4 is a transverse cross sectional view of the embodiment shown in FIG. 3 taken along the line 4—4 thereof.

The lower end of the brush spindles $64_1 \ldots 64_4$ of the four brushes $36_1 \ldots 36_4$ are rotatably driven by means of an electric motor 68 and a drive mechanism 70 comprised of a pinion type gear train located in the lower compartment 28. Access to the lower compartment 28 is provided by means of a flat end plate 72 held in place by means of screw type hardware 74. The gear train 70 is shown in FIG. 4 comprised of a central pinion gear secured to the shaft of the motor 68 and operates to turn a set of four equally spaced pinion gears $78_1$, $78_2$, $78_3$ and $78_4$ for rotating a respective brush of the brushes $36_1$, $36_2$, $36_3$ and $36_4$. Each of the driven pinion gears $78_1$, $78_2$, $78_3$ and $78_4$ are connected to respective slotted shafts $80_1 \ldots 80_4$, one of which $80_1$ is shown in detail in FIG. 5, which extend through the wall 32 separating the upper and lower compartments 28 and 30 to engage the lower end of the brush spindles $64_1 \ldots 64_4$.

Figure 5:
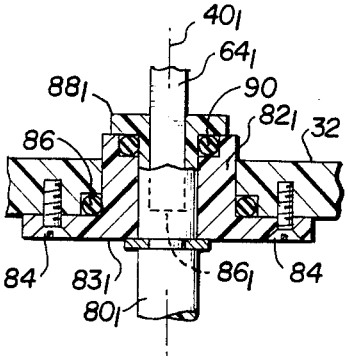
FIG. 5 is a partial longitudinal sectional view of the power coupling mechanism shown in FIG. 3 taken along the line 5—5 thereof.

A low friction, liquid tight connection through the wall 32 is provided for each of the shafts $80_1 \ldots 80_4$ by a "Teflon" bearing subassembly depicted in FIG. 5. There one flanged "Teflon" bearing $82_1$ is shown held in place by screw type hardware 84 inserted through the flange $83_1$ into the lower surface of the wall 32. An adjoining O-ring 86 is also included at the interface between the bearing $82_1$ and the wall 32. The upper end of the drive shaft $80_1$ also includes a socket type bore $86_1$ for receiving the spindle $64_1$ in its upper end and further includes a flange $88_1$ which abuts the upper surface of the bearing $82_1$. A second O-ring member 90 is also included at the interface between the flange $88_1$ and the upper surface of the bearing $82_1$. Such a configuration permits the brushes $36_1 \ldots 36_4$ to be changed at will without disturbing the drive mechanism 70 or the electric motor 68, or vice versa.

The preferred embodiment of the invention also includes an electrical switch 92 which may be, for example, a microswitch located in the lower compartment 28 but which has its actuator element 94 projecting through a hole in the wall 32 so that it can be actuated by the butt end 46 of the grip 44 when the grip end of the golf club 21 is inserted downwardly into the upper compartment 30 between the brushes $36_1 \ldots 36_4$. A plastic covering 96 is provided over the actuator 94 and is secured against the inner surface of the wall 32 to provide a liquid tight seal for the switch 92. The switch 92 is coupled to the power cord 24 shown in FIG. 1 and includes electrical wiring 98 to the motor 68 for controlling the application of electrical power thereto.

Thus in operation, one would place the grip end of a golf club 21 between the brushes $36_1 \ldots 36_4$ and exert a downward pressure on the shaft 22 to operate the electrical switch 92 which causes the electric motor 68 to be energized and rotate the brushes so that they bring cleaning liquid 56 into contact with and scrub the outside surface of the grip 44 thereby removing perspiration, dirt and any other foreign material that requires removing. When the golf club 21 is lifted upwardly and out of the housing 10, the switch 92 will be deactivated and the electrical motor 68 will turn off, causing the brushes to stop rotating. The golf grip 44 can then be wiped down and dried off as desired.

Figure 6:
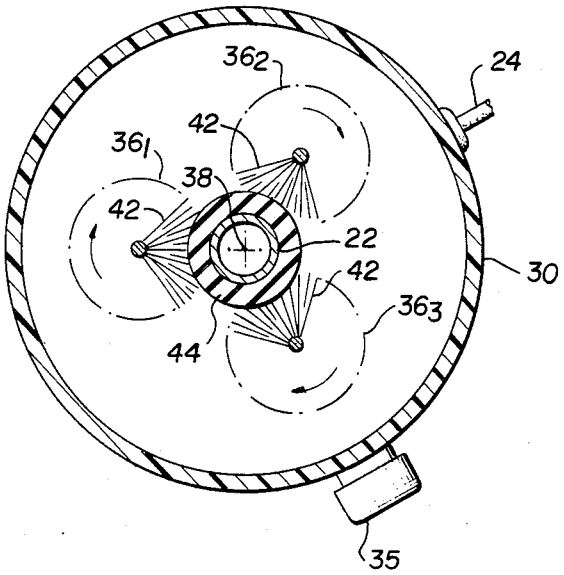
FIG. 6 is a transverse sectional view illustrative of an alternative embodiment of the invention.
Figure 7:
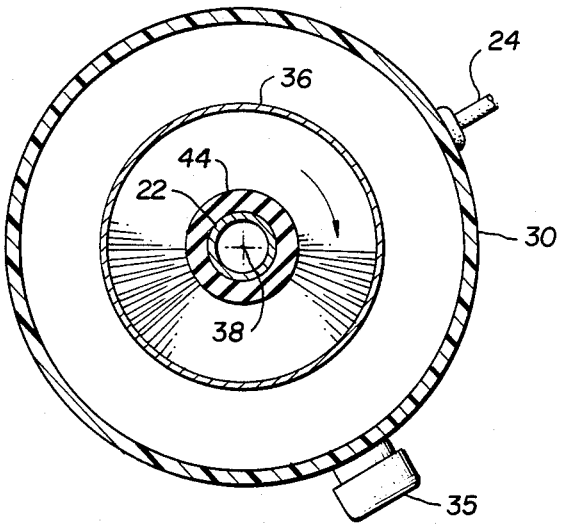
FIG. 7 is a transverse cross sectional view of still another embodiment of the invention.

While the foregoing has been disclosed with reference to four brush configuration which is adapted to substantially completely encircle the grip of a golf club, the embodiments shown in FIGS. 6 and 7 are intended to generally depict two other embodiments which may be implemented. The embodiment shown in FIG. 6 is similar to that previously described with the exception that it is intended to be configured with three equally spaced brushes $36_1$, $36_2$, $36_3$ located around the central axis 38. Such an arrangement, however, may result in all of the grip surface not being scrubbed simultaneously. Nevertheless, it would merely require a slight rotation of the golf club shaft 22 by the user to achieve a full cleaning action.

With respect to the configuration shown in FIG. 7, it is comprised of a single coaxial annular brush member 36 in the form of an elongated tube which is adapted to completely envelop the grip 44 when inserted into the upper compartment 30. Rotation of the brush 36 is provided by a drive mechanism, not shown, coupled to the electric motor 68.

Thus what has been shown and described is a simple yet effective device for cleaning the grips of athletic equipment, particularly golf clubs. It should be borne in mind that the motor driven cleaning apparatus as described above can be further modified to accommodate other types of equipment having a hand grip such as a tennis, handball or squash racket as well as a ball or puck striking stick or bat.

Having thus shown and described what is at present considered to be the preferred embodiments of the invention, it should be noted that the same has been made by way of illustration and not limitation. Accordingly, all modifications, alterations and changes coming within the spirit and scope of the invention as defined in the appended claims are herein meant to be included.

I claim:

1. An apparatus for cleaning the grip of a golf club comprising:

an upright elongated housing including a coextensive chamber adapted to be filled with a cleaning liquid to a level substantially completely submerging the hand grip of a golf club inserted into the housing;

circumferentially spaced parallel axis substantially cylindrical rotary golf club grip scrubbing brushes journaled in the housing and being spaced equidistantly from the center of the housing to define a center golf club grip cleaning space in the housing surrounded by said brushes, the brushes extending substantially for the entire depth of the housing and being substantially completely submerged in a cleaning liquid filling the chamber;

power means located in a chamber forming an extension of said housing, said power means being connected with the brushes to rotate them in unison on their parallel axes;

a removable closure cap for the top of the housing having a centr golf club grip insertion and removal opening in coaxial alignment with said central golf club hand grip cleaning space; and means secured to said housing for mounting the apparatus in a use position.

2. The apparatus for cleaning the grip of a golf club as defined in claim 1 wherein said power means comprises a motor and drive gearing disposed in said chamber forming an extension of said housing.

3. The apparatus for cleaning the grip of a golf club as defined by claim 2 wherein said motor comprises an electric motor and additionally including switch means on said housing coupled between a source of electrical power and said electric motor for turning said motor on and off.

4. The apparatus for cleaning the grip of a golf club as defined in claim 1, wherein said rotary brushes include shaft extensions at each end thereof, and additionally including:

a plate held between one end face of said housing and an opposing surface of said closure cap and having a center golf club shaft clearance opening and a plurality of circumferentially spaced openings receiving said shaft extensions of the brushes at corresponding ends of the brushes and stabilizing the brushes during their rotation.

5. The apparatus for cleaning the grip of a golf club as defined by claim 4 wherein said motor comprises an electric motor and additionally including electrical switch means coupled into said liquid filled chamber and being actuable by the hand grip when inserted into the housing for coupling a source of electrical power to said motor.

6. The apparatus for cleaning the grip of a golf club as defined by claim 5 wherein said liquid filled chamber and said chamber forming an extension of said housing include a common wall and wherein said electrical switch means is mounted in said common wall.

7. The apparatus for cleaning the grip of a golf club as defined by claim 1 wherein said housing comprises a generally cylindrical housing having an axial length which is at least twice its diameter.

8. The apparatus for cleaning the grip of a golf club as defined by claim 1 and additionally including an elastic golf club shaft engaging seal on the removable closure cap adjacent to said center opening of the closure cap.

* * * * *